US012455148B2

(12) United States Patent
Miniailuk

(10) Patent No.: US 12,455,148 B2
(45) Date of Patent: Oct. 28, 2025

(54) ANTI-MINE PAD "SAFESTEP"

(71) Applicant: Sergii Miniailuk, S. Struha (UA)

(72) Inventor: Sergii Miniailuk, S. Struha (UA)

( * ) Notice: Subject to any disclaimer, the term of this patent is extended or adjusted under 35 U.S.C. 154(b) by 259 days.

(21) Appl. No.: 18/232,954

(22) Filed: Aug. 11, 2023

(65) Prior Publication Data

US 2024/0369327 A1 Nov. 7, 2024

(51) Int. Cl.
*F41H 11/12* (2011.01)

(52) U.S. Cl.
CPC ..... *F41H 11/12* (2013.01)

(58) Field of Classification Search
CPC ..... F41H 11/12; F41H 1/00
See application file for complete search history.

(56) References Cited

U.S. PATENT DOCUMENTS 8,047,117 B1 * 11/2011 Tan ..... F41H 1/00 36/73
2007/0044645 A1 * 3/2007 Fuss ..... F41H 11/136 89/1.13
2009/0090024 A1 * 4/2009 Phlawadana ..... A43B 13/14 36/85
2014/0150293 A1 * 6/2014 Millar ..... A43B 13/141 36/103

FOREIGN PATENT DOCUMENTS

CA 2290554 C * 1/2006

* cited by examiner

*Primary Examiner* — Samir Abdosh
(74) *Attorney, Agent, or Firm* — Nadya Reingand

(57) ABSTRACT

Invention is an anti-mine pad for protecting legs against anti-personnel pressure-type mines. The pad comprises a rigid horizontal platform, support legs and footwear-fastening elements. The platform has an upper surface for footwear and a lower convex surface. The lower convex protrusion's vertex faces downwards. The platform's lower surface lacks parallel planes when projecting a human foot relative to the upper surface. The support legs provide a space between the platform and the ground. Contact points between the support legs and the ground are outside the platform. The arrangement height of the platform's upper surface above the ground is 40-99 mm. Rigid polymeric material of the pad's inner frame has a greater rigidity than an outer shell's material. The pad protects the human foot against explosions of the anti-personnel pressure-type mines, has small weight, dimensions, is convenient for transportation, easily taken off/worn and reliably hold the user on a surface.

8 Claims, 6 Drawing Sheets

ANTI-MINE PAD "SAFESTEP"

FIELD OF THE INVENTION

Figure 1:
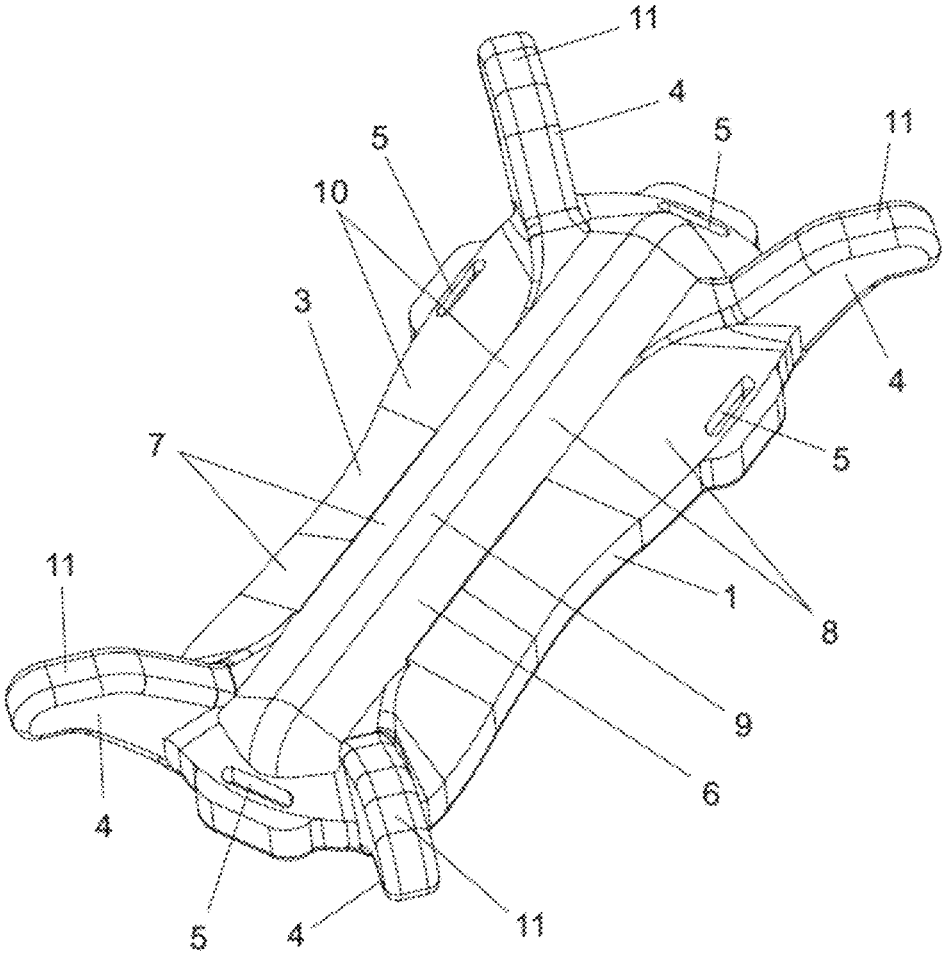

The invention relates to a field of military and special equipment, in particular, the invention is a structure of an anti-mine pad for protecting legs against anti-personnel pressure-type mines. In particular, the invention is to be used by military personnel which move across mined areas and/or participate in mine clearance operations. The claimed structure also may be used by another military and civilian personnel.

PRIOR ART

In the most disclosed cases, modern anti-personnel pressure-type mines (e.g., MN1, PMN-2, PMN-3, PMN-4, PFM-1 etc.) are primarily used to cause a maximum damage of legs (feet) of military or civilian personnel in order to cause serious life-threatening injuries. When a human foot contacts a blast anti-personnel mine, an explosive substance will detonate, and the foot is located in a brisant action area of the explosion at the moment of explosion. Brisance is an ability of explosive substances to shatter and to break media which are adjacent to a charge. The brisance is caused by an impact force of detonation products and arises only in case of a close proximity to the charge at a distance that is not more than 2.0-2.5 of a charge radius (https://uk.wikipedia.org/wiki/Бризантність ). Brisant action of typical anti-personnel mines has a maximum destructive energy that results in a maximum injure of the leg in most of damaging cases. At this damage, human will require medical complex emergency care and emergency evacuation. During military actions, in marches (diversionary, reconnaissance, other marches) and common movement of military and civilian personnel through a mined area or during clearance of the mined areas, there is a need in tools, devices and equipment that could provide a maximum possible protection of legs of military personnel, specialists, civilian personnel against the destructive energy of the brisant action of the anti-personnel mines which would decrease the damaging energy of the brisant action that acts on the human leg to a maximum possible extent and would not allow to cause serious damages for the human, e.g., full or partial crush of the foot, tear of tissues, massive hemorrhage and other cases, even lethal ones. By achieving the significant decrease of the damaging effect of the anti-personnel mine, there will be no need in emergency evacuation of the human that has contacted the mine, there will be no need in emergency complex medical invasion and care which would significantly increase chances to save the human leg and life.

A structure of an element of protective military shoes for an anti-personnel mine is known, and the structure has an improved engagement with the military shoes (Korean invention patent No. KR101478005B1, IPC A43B3/00; A43B3/16, publ. on 2 Jan. 2015). This structure comprises a sole in a form of a rigid horizontal platform having an upper surface that is fixed to "protective overshoes" which are attachment elements for attaching to the military shoes. A lower surface of the platform (sole) has an aerodynamic shape in order to decrease the influence of explosion striking factors. The sole platform comprises support legs which are connected to the lower surface of the platform and contact with the ground. Said support legs are arranged vertically relative to the horizontal surface of the platform in order to provide a stable support of the platform on the ground surface, while providing a space above the ground surface, in order to support the shoes and the foot in a place that is arranged at a certain height above the ground surface. This invention relates to elements of the protective shoes for anti-personnel mines and is intended to allow walking on slopes and sideway areas, where the anti-personnel mines could be located. The structure enhances the engagement between the protective element and the military shoes as well as it is intended to protect a leg bone against damaging by explosions of the anti-personnel mines which are known as "bone mines". However, this technical solution cannot have maximum efficiency against the explosive brisant action of the anti-personnel mine, since contact points (places) between a pad (the sole) and the ground surface are arranged directly beneath the sole platform and are parallel to the upper surface. Therefore, this structure will not provide a maximum possible protection of the human foot against explosion striking factors.

A technical solution that is the closest solution to the claimed invention is a structure of a protection system for protecting legs against anti-personnel mines (U.S. Pat. No. 6,006,646A, IPC A43B3/00, F41H5/08, publ. on 28 Dec. 1999) comprising a rigid horizontal platform, support legs and footwear-fastening elements. Said horizontal platform has an upper surface for the footwear and a lower surface having a convex shape to decrease the influence of explosion striking factors. The support legs are connected to the lower surface of the platform, contact with the ground surface and arranged in such a way that contact points between the support legs and the ground surface are located outside the platform. The platform is arranged on the support legs in such a way that it provides a space h2 between the upper surface and the ground surface.

Said device may be used as a lower supplementary element for the footwear in order to protect the legs against the explosion in case of their contact with the anti-personnel mine. However, when using this structure in practice, the following drawbacks exist:

- bulkiness and heavy weight, thereby causing difficulties during common transportation (requiring an additional equipment) and complicating human walking when in use;
- too high support legs and too large distance h2 between the horizontal sole platform and the ground surface, thereby also complicating human walking;
- imperfect aerodynamic shape of the lower surface of the platform that does not provide maximum withdrawal and re-directing of a portion of the destructive energy of the explosion;
- presence of rigid and solid materials (including those made of metal) which may form their own sharp and solid shards under the brisant action of the explosion which also may damage the human;
- presence of metal pieces which may activate modern magnetic mines;
- complexity and rigid fixation/attachment of the device to the footwear which may result in "twisting" of the leg foot together with the footwear and with the rigidly attached device at the moment of explosion which eventually would lead to serious traumatic injuries.

Therefore, this known protection system for protecting the legs against the anti-personnel mines does not provide a maximum possible protection of the human foot against striking influence of the explosion factors of the anti-personnel mines, has heavy weight and large dimensions, is heavy and inconvenient for transportation, and does not reliably and conveniently hold the human together with combat gear or special equipment during walking.

A technical objective of the present invention is to provide a structure of an anti-mine pad that could protect a human foot against explosions of anti-personnel pressure-type mines, could have a low weight and small dimensions, could be easy and convenient for transportation, while, at the same time, could be easily taken off and worn, and could reliably hold a user on the ground surface, including a user with an additional equipment.

Technical effects which are achieved by a set of all essential features of the invention include:

- achieving structural strength and rigidity in order to enable withstanding a human weight with weapons and with a combat gear or special equipment for a total weight of up to 120 kg;
- enabling to raise the foot above the ground surface for 40 mm and higher;
- decreasing the influence of explosion striking factors;
- avoiding formation (in case of explosion) of rigid, solid and sharp shards of the structure which could damage the human;
- providing easy and quick separation of shards of pieces of the structure from the footwear in case the anti-personnel mine exploded in the foot area;
- avoiding activation of modern magnetic mines by the elements of the anti-mine pad structure;
- providing a stable positioning of the user legs when moving on the ground surface in various climate conditions.

SUMMARY OF THE INVENTION

The objective is achieved by providing an anti-mine pad comprising a rigid horizontal platform 1, support legs 4 and footwear-fastening elements. Said platform 1 has an upper surface 2 for a footwear and a lower surface 3 having a convex shape to reduce an influence of explosion striking factors. The support legs 4 are connected to the lower surface 3 of the platform 1, contact by their own support surfaces 11 with a ground surface and arranged in such a way that contact points between the support legs 4 and the ground surface are located outside the platform 1. The platform 1 is arranged on the support legs 4 in such a way that it provides a space h2 between the upper surface 2 and the ground surface.

Novel features are as follows: the lower surface 3 of the platform 1 is made such that it has a convex protrusion 6 with a vertex 9 and two inclined surfaces 7, 8, and the vertex 9 of this convex protrusion 6 faces towards a bottom of the anti-mine pad and arranged primarily along a central axis of the lower surface 3 of the platform 1 in such a way that the lower surface 3 of the platform 1 in a form of the inclined surfaces 7, 8 and their shared vertex 9 has no parallel planes in a projection of a human foot relative to the upper surface 2. The structure of the platform 1 with the support legs 4 is formed by a rigid polymeric inner frame and a polymeric outer shell 10 that is externally applied to the rigid polymeric inner frame, and the inner frame rigid polymeric material has a higher rigidity than a polymeric material of the outer shell 10. The arrangement height h2 of the upper surface 2 of the platform 1 above the ground surface is from 40 mm to 99 mm.

For some specific conditions, embodiments and applications of the invention, the claimed anti-mine pad is characterized by the following features which develop and specify a set of features provided in independent claim.

Each of the two lateral inclined surfaces 7, 8 of the convex protrusion 6 of the lower surface 3 of the platform 1 is curved or flat and arranged at an angle $\alpha$ relative to the upper surface 2.

The anti-mine pad comprises four support legs 4, and two of them are arranged in a front part of the platform 1, while other two support legs 4 are arranged in a rear part of the platform 1.

The support legs 4 are interconnected in an area of their own support surfaces 11 by means of elements which are made of an elastic polymer.

A level of the lower support surface 11 of each of the support legs 4 and a lower level of the vertex 9 of the convex protrusion 6 lie in the same plane or a height h1 between the level of the lower support surface 11 of each of the support legs 4 and the lower level of the vertex 9 of the convex protrusion 6 is 0.1 mm or more than 0.1 mm.

The upper surface 2 of the platform 1 has a corrugated surface.

The anti-mine pad is made as an individual device, and the footwear-fastening elements are openings 5 which are provided in both a "toe area" and a "heel area" of the platform 1 and straps which are inserted into said openings 5 of the platform 1 so as the straps are attachable to the footwear and enable a detachment of the fastening elements under a brisant action of an explosion and due to a destruction of the platform 1.

The anti-mine pad is made as an integral part of the footwear.

Inventive Step

The platform 1 and the support legs 4 are main elements of the structure (FIG. 1-6). After the anti-mine pad is manufactured, it appears that the platform 1 with the support legs 4 and, e.g., with the openings 5 is made as a single solid one-piece component. From the outside, the pad looks like this, however, its structure is formed by at least two components, i.e., the rigid polymeric inner frame and the polymeric outer shell 10 that is applied to the rigid polymeric inner frame. Use of the polymeric materials allows to provide the pad that has low weight which is convenient for transportation and use.

The original and non-standard solution of the invention is that the structure utilizes polymeric materials having different physical and mechanical characteristics, the rigid frame and the coating. At the same time, it should be noted that the elements of the rigid inner frame are arranged not only inside the platform 1, but also in each of the support legs 4, and the entire rigid inner frame is externally coated with another polymeric material that forms the outer shell 10.

Use of the polymeric materials having different characteristics in the structure provides the following advantages:

- firstly, it allows to provide rigidity and stability of the pad in terms of reliable holding of the human with weapons and equipment (i.e., with the maximum possible weight of up to 120 kg inclusively) on the anti-mine pads during walking, while, at the same time, the upper surface 2 of the platform 1 in the form of the polymeric outer shell 10 is flexible and elastic, thereby providing the enhanced engagement with the footwear sole, when the anti-mine pad is a separate device (meaning that when the anti-mine pad is not an integral part of the footwear);
- secondly, it allows to absorb the explosion influence; a first protection degree is a layer of the outer shell 10, a second protection degree is a structure of the rigid inner frame inside the pad;

thirdly, it should be noted that a main purpose of using the claimed anti-mine pad is to achieve the effect of maximum decrease of the influence of the explosion striking factors acting on the leg also by destruction (breakage/rupture) of the anti-mine pad and easy withdrawal of its shards from the footwear without causing any serious injure of the human leg; thus, the two layers of different polymeric materials successively perform this function and at the moment of receiving and reflecting the energy of the explosion brisant action, the flexible outer shell 10 is ruptured and the inner frame is broken, while, at the same time, it is quickly and easy separated from the footwear in different directions, while the polymeric pieces of both layers of the anti-mine pad do not form any dangerous sharp and solid shards which could cause serious injures of the foot and human; therefore, the polymeric outer shell 10 and the inner frame of the pad "take over" and absorb the maximum amount of the explosion energy, "withdraw" this energy from the foot and "absorb/dampen" this energy, are destroyed under its action and separated in different directions from the footwear and from the foot without causing any serious damages of the foot by their own shards; the described breakage of the anti-mine pad into non-damaging pieces due to and after absorption of the explosion energy is unpredictable and unexpected effect of the invention that has been revealed during actual tests and experiments, and in each of at least ten cases, the following has occurred: absorption and redirecting the explosion action, breakage of the anti-mine pad into pieces, discarding large pieces in different directions from a foot model in the footwear;

fourthly, use of the polymeric materials only allows to avoid any possible activation of various magnetic mines which are capable of reacting to metals.

The rigid horizontal platform 1 comprises the upper surface 2 (FIG. 2, 3, 4, 6) having a shape that is made in such a way that it allows a convenient mounting of the footwear thereon in cases when the anti-mine pad is made as a separate device. In these cases, the upper surface 2 of the platform 1 may have the corrugated surface that provides better engagement with the footwear sole. In other individual cases, when the anti-mine pad is made as an integral part of the footwear, the rigid horizontal platform 1 acts as the footwear sole and, thus, the engagement with the sole is not important, since the fixation is made by means of other elements of the footwear structure.

The rigid horizontal platform 1 comprises the lower surface 3 having a convex shape in order to decrease the influence of the explosion striking factors (FIG. 1, 3, 4, 5). The original technical solution is that the convex shape of the lower surface 3 of the platform 1 is made in the form of the convex protrusion 6 that faces towards the bottom of the anti-mine pad. The convex protrusion 6 comprises the vertex 9 and the two inclined surfaces 7, 8. The vertex 9 of this convex protrusion 6 faces towards the bottom of the anti-mine pad and arranged primarily along the central axis of the lower surface 3 of the platform 1 in such a way that the lower surface 3 of the platform 1 in the form of the inclined surfaces 7, 8 and their shared vertex 9 has no parallel planes in the projection of a human foot relative to the upper surface 2. It should be noted that any surfaces are arranged horizontally-perpendicularly or almost horizontally at a small angle relative to a direction of the explosion (shock wave), increase an area of influence of the explosion energy and increase an area of the explosion force applied to these surfaces which, thus, in combination, increases the destructive and traumatic influence of the explosion energy onto the human foot through any flat horizontal surface (sole, footwear pad etc.) and causes a serious traumatic damage of the human leg (foot), because the explosion force acts almost in a straight forward manner. Thus, the fact that the lower surface 3 of the platform 1 and adjacent pieces and locations in the projection of the foot do not have any lower horizontal surfaces significantly decreases the straight forward action of the destructive explosion energy onto the human leg.

Besides, the presence of the vertex 9 and flat or concave or convex (in individual embodiments of the invention) surfaces 7, 8 of the convex protrusion 6 provides the withdrawal and redirecting of the portion of the destructive explosion energy in side directions from the human foot that is arranged horizontally and perpendicularly to the direction of the explosive brisant energy.

Figure 2:
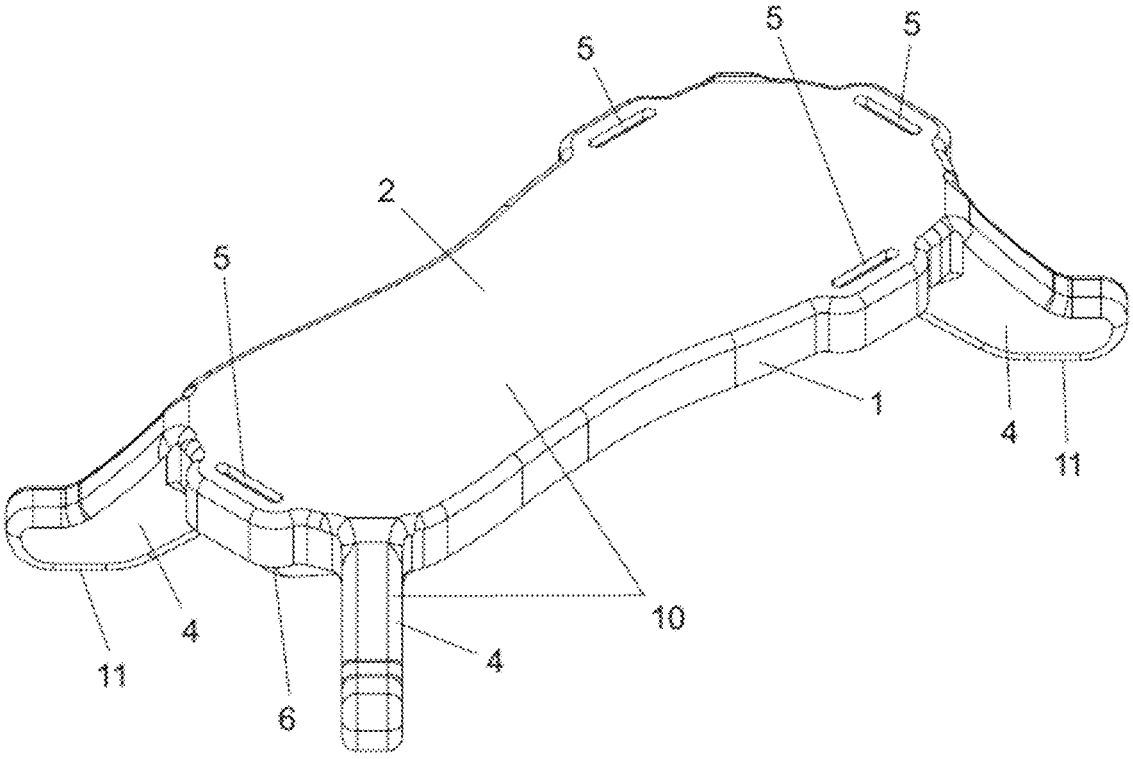
Figure 3:
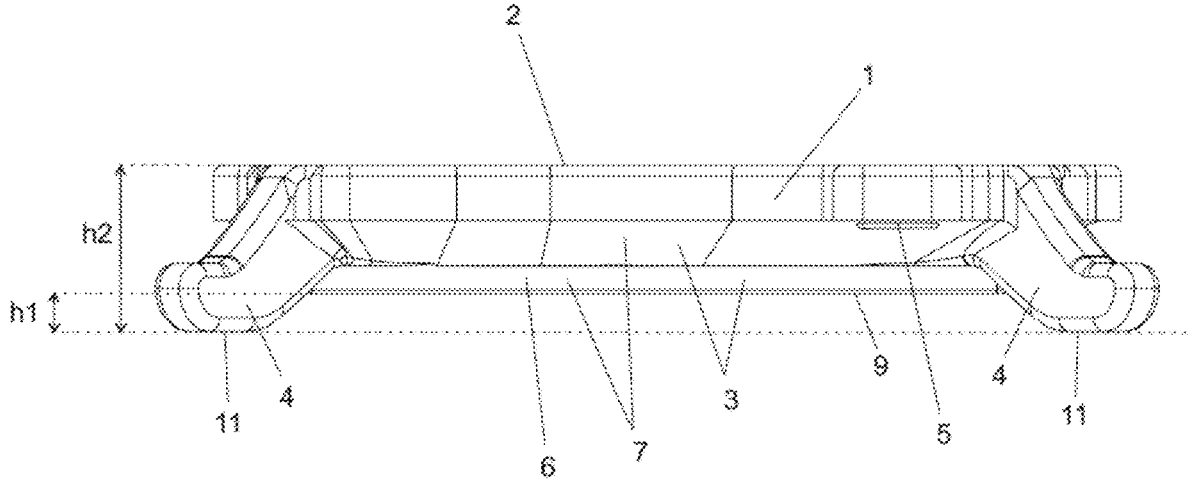

The support legs 4 are connected to the lower surface 3 of the platform 1 and contact, by their own support surfaces 11, with the ground surface. In most of embodiments, the anti-mine pad comprises four support legs 4, and two of them are arranged in the front part of the platform 1, while other two support legs 4 are arranged in the rear part of the platform 1 (FIG. 1-6). If necessary, the number of the support legs 4 may be increased, e.g., when the pad is used with a maximum footwear size. Also, the support legs 4 may be connected between each other (in the area of their own support surfaces 11), e.g., by means of horizontal pieces (bridges) made of elastic polymer (not shown in the drawings) in order to increase the area of contact with the ground surface and, thus, in order to provide more stable/reliable holding of the user on the support surface in cases when the ground surface is soft soil, snow etc. The support legs 4 are arranged in such a way that points of contact (the support surfaces 11) between the support legs 4 and the ground surface in the projection of the rigid frame of the anti-mine pad are arranged outside the platform 1, thereby increasing a resistance perimeter of the anti-mine pad (FIG. 1-6). Also, the structural "taking" the points of contact between the support legs 4 and the ground surface outside the platform 1 edges somewhat moves away a possible explosion epicenter away from the platform 1 and from the human foot, when the anti-personnel mine is activated by any one of the support legs 4, rather than the lower surface 3 of the platform 1. The platform 1 is arranged by means of the support legs 4 in such a way that it provides a space above the ground surface for the upper surface 2 at the height h2 (FIG. 3). According to the invention, the height h2 is from 40 mm to 99 mm. Said height h2 (in the most preferable embodiments, it is approximately 50 mm) enables more convenient and efficient (as compared to the known analogues and prototype) walking on the anti-mine pads, since it is not too large. Also, said height h2 in combination with the convex protrusion 6 of the lower surface 3 of the platform 1 are sufficient factors to provide withdrawal, redirecting and absorption of most of the destructive explosion energy without causing any serious damages and injures of the human foot which has been found and confirmed experimentally using imitation models of the foot and footwear. Said height h2 that is from 40 mm to 99 mm between the upper surface 2 and the ground surface has been found by performing theoretical and practical studies that have shown and confirmed that if the height h2 is outside these values, the technical effects of the invention will not be achieved or they will not be achieved completely. That is, if the height h2 is too high, e.g., 110 mm or 120 mm and more (as shown in the prototype), then this pad will not provide the positioning stability of the user legs when moving on the ground surface in various climate conditions and will not allow to hold the user reliably on the ground surface. Besides, the large height h2 (more than 99 mm) will make the structure bulkier and inconvenient for packing into the equipment and for the transportation. If the height h2 between the upper surface 2 of the platform 1 (and, thus, the human foot) and the ground surface is less than 40 mm, then this decreased distance/height will be insufficient to enable effective withdrawal, redirecting and absorption of the most of the destructive energy of the explosion striking factors, including the brisant action energy. Therefore, if the height h2 is too low, e.g., from 20 mm to 30 mm, then the anti-mine pad having this arrangement height h2 of the upper surface 2 of the platform 1 above the ground surface will not allow to effectively decrease the influence of the explosion striking factors of the anti-personnel pressure-type mine acting on the human foot.

Figure 4:
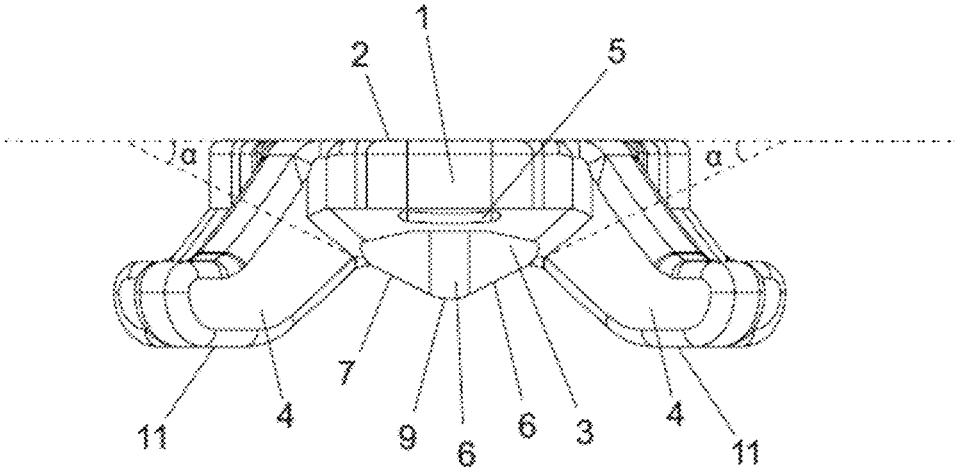

In separate embodiments of the invention, the level of the lower support surfaces 11 of the support legs 4 and the lower level of the vertex 9 of the convex protrusion 6 may lie in the same plane, i.e., on the same horizontal level (not shown in the drawings). Alternatively, the height h1 between the levels of the lower support surfaces 11 of the support legs 4 and the lower level of the vertex 9 of the convex protrusion 6 may be from 0.1 mm and higher than 0.1 mm, i.e., the level of the vertex 9 of the convex protrusion 6 is higher above the ground surface as compared to the contact points (the support surfaces 11) between the support legs 4 and the ground surface (FIG. 4). This "variance" allows to manufacture and to use the anti-mine pads for various surfaces and for various weight loads. That is, when the support surfaces 11 of the support legs 4 and the lower level of the vertex 9 of the convex protrusion 6 lie in the same plane, the entire length of the vertex 9 of the convex protrusion 6 also (together with the support legs 4) abuts the ground, soft soil, snow, ice, thereby providing more stable/reliable holding of the large weight user on the surface. The inventive structure in which the lower level of the vertex 9 of the convex protrusion 6 is higher than the level of the support surfaces 11 of the support legs 4 allows to manufacture and to use the anti-mine pads which are primarily intended for a more solid ground surface and for users of lower weight or with less equipment.

The claimed anti-mine pad is used together with the footwear and, thus, the platform 1 comprises footwear-fastening elements. According to the structure, in separate embodiments of the anti-mine pad, it may be made as a separate device or as an integral part of the footwear being, for example, a sole.

If the structure is made as the separate device, the footwear-fastening elements are openings 5 which are provided in the "toe area" and in the "heel area" of the platform 1 (FIG. 1, 2, 5, 6). Straps (slings) or polymeric fixation elements (not shown in the drawings) are inserted into said openings 5, thereby fastening the anti-mine pad to the footwear. As mentioned above, in most of cases of contact with the anti-personnel mine, the explosion will result in breakage of the platform 1 and detachment of the fastening. Owing to the fact that the fastening elements (the straps) are not fully rigidly attached to the platform 1, but merely inserted into the openings 5, they allow easy "falling" of the shards of the platform 1 from the footwear without any rigid, drastic and strong capture of the human foot together with the destroyed parts of the footwear platform 1, thereby allowing to avoid any serious injure and damages of the leg.

When the structure is made as the integral part of the footwear, for example, as the sole, the footwear-fastening elements are adhesive seams or casting connection points between the lower part of the footwear and the platform 1. In preferable embodiments of this footwear, various materials having protective properties are used for manufacturing the upper part ("aramid" etc., but without limitation thereto; "aramid" is a material made of aramid heat-resistant and strong fibers-https://en.wikipedia.org/wiki/Aramid). The upper part of the footwear (tissue) is glued or connected by means of casting to the anti-mine sole pad without providing a strong fixation of the materials so as to enable easy separation of the platform 1 (sole) from the footwear as a result of the brisant action of the possible explosion. Thus, this solution also enables easy "separation" of the shards of the anti-mine sole pad from the upper part of the footwear without any rigid, drastic and strong capture of the human foot together with the upper part of the footwear, thereby allowing to avoid any serious injure and damages.

Therefore, the set of all essential features of the invention, including its novel features, allows to achieve said technical effects completely.

Practical implementation and industrial applicability of the anti-mine pad will be explained by schematic illustrations of the structure, description of the elements of this structure and its exemplary operation.

LIST OF FIGURES OF THE DEVICE

Figure 5:
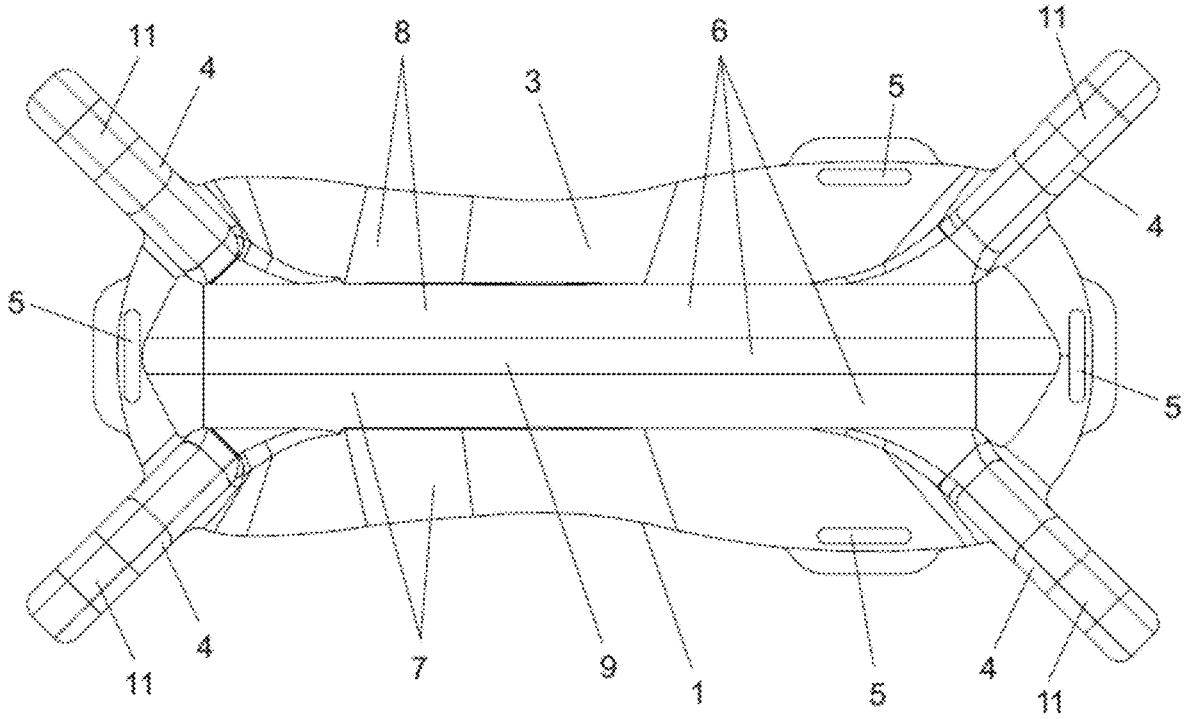
Figure 6:
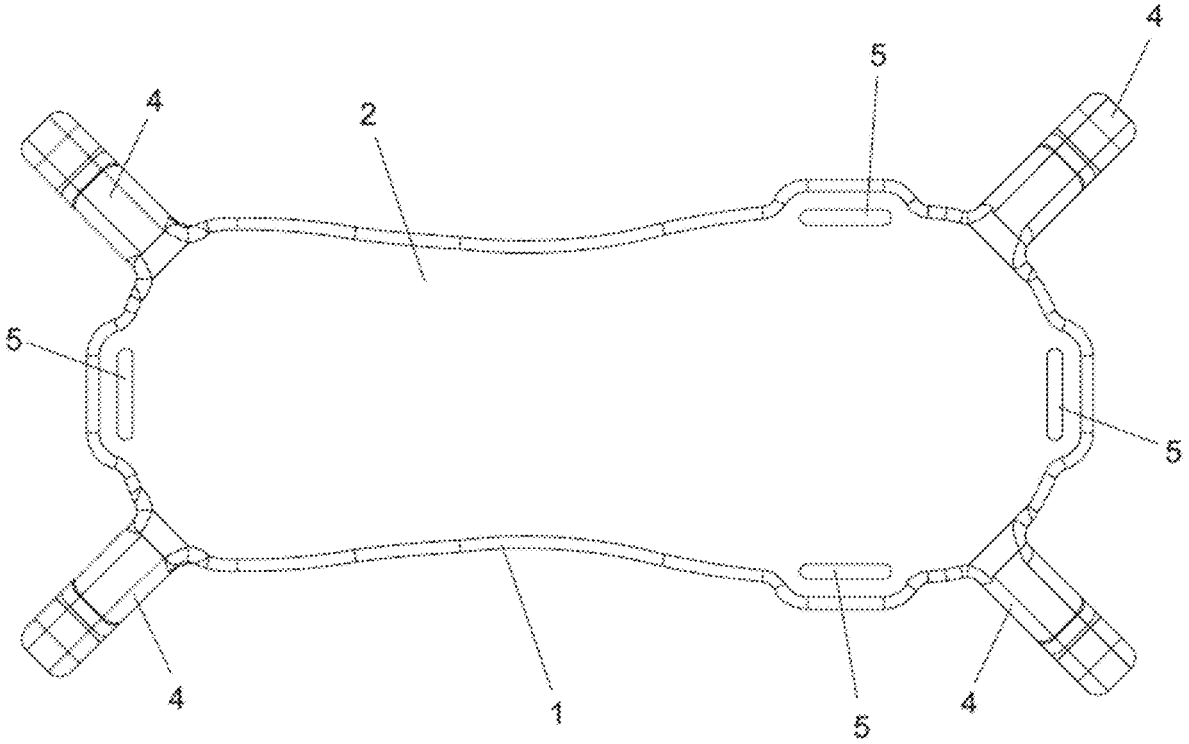

FIG. 1 is a general ¾ bottom view of the anti-mine pad;
FIG. 2 is a general ¾ top view of the anti-mine pad;
FIG. 3 is a side view of the anti-mine pad;
FIG. 4 is a rear view of the anti-mine pad;
FIG. 5 is a bottom view of the anti-mine pad;
FIG. 6 is a top view of the anti-mine pad.

List of photos (annexes to the Figures for explaining the nature of the invention).

Nomenclature list of elements of the anti-mine pad:

1—rigid horizontal platform;
2—upper surface of the platform 1;
3—lower surface of the platform 1;
4—support legs;
5—openings of the platform 1 (footwear-fastening elements);
6—convex protrusion on the lower surface 3 of the platform 1;
7, 8—inclined surfaces of the protrusion 6;
9—vertex of the protrusion 6;
10—polymeric outer shell of the anti-mine pad structure;
11—lower surfaces of the support legs 4 (contact points between the support legs 4 and the ground surface);
h1—height between the level of the lower support surface 11 of each of the support legs 4 and the lower level of the vertex 9 of the convex protrusion 6;
h2—height of arrangement of the upper surface 2 of the platform 1 above the ground surface;
α—inclination angle of each of the two lateral inclined surfaces 7, 8 of the convex protrusion 6 relative to the upper surface 2 of the platform 1.

Description of the Structure in Static

The structure of the anti-mine pad comprises the following main elements: the rigid horizontal platform 1 with the upper surface 2, the lower surface 3, the support legs 4 which are connected to the lower surface 3 of the platform 1 and contact with the ground surface, and the footwear-fastening elements formed as, e.g., the openings 5 (but without limitation thereto).

The upper surface 2 (FIG. 2, 3, 4, 6) of the platform 1 is intended to mount the footwear thereon. In separate embodiments of the invention, when the anti-mine pad is made as a separate device, the upper surface 2 may be corrugated (not shown in the drawings). In these particular embodiments (when the pad is the separate device), the footwear-fastening elements are openings 5 (FIG. 1, 2, 5, 6) which are provided in the "toe area" and the "heel area" of the platform 1, and the straps or polymeric fixation elements (not shown in the drawings) which are inserted into said openings 5 of the platform 1 so as to enable its fastening to the footwear and its fixation together with the footwear. The "straps" for fastening the platform 1 and the footwear together may represent belt straps or strap slings or ropes and other similar flexible, lightweight and tough elements. It should be noted that the inventive structure provides that the footwear-fastening elements in the form of the openings 5 and the straps are made, arranged and mounted so as to enable easy "separation" of said straps from the platform 1 as a result of the brisant action of the possible explosion. This effect is achieved owing to the fact that one the platform 1 is one of the fixation sides, and upon its destruction, the fixation connection to the leg will be significantly loosened or completely eliminated in any side of the platform. Except for the straps (slings), the polymeric fixation elements (not shown in the drawings) may be inserted into said openings 5, thereby fastening the anti-mine pad to the footwear. The fixation elements also enable easy "falling" of the shards of the platform 1 from the footwear without capturing together with the destroyed parts of the footwear platform 1 and the human foot, thereby allowing to avoid any serious injure/damage of the leg.

In other separate embodiments of the claimed structure, when the anti-mine pad is made as an integral part of the footwear (in the form of the sole), the upper surface 2 of the platform 1 is a location (a plane) of connection of the anti-mine pad directly to the lower part of the footwear. In these embodiments, the footwear-fastening elements of the platform 1 are adhesive seams or casting connection points between the upper part of the footwear and the platform 1. Also, the platform 1 may be fastened to the upper surface 2 of the platform 1 not only by adhesion or casting method, but also by any other connection method that is reasonable in terms of technological needs and possibilities. At the same time, it should be noted that the inventive structure provides that the footwear-fastening elements in the form of adhesive seams or casting connection points or other are provided and arranged so as to enable "easy" separation of the platform 1 from the footwear as a result of the brisant action of the possible explosion. In these embodiments, the upper element of the footwear may be made from special lightweight and flexible soft tissues or materials which will be easily separated from the platform 1 upon explosion and will not fix the foot to the platform 1 in a completely rigid fashion.

The lower surface 3 (FIG. 1, 3, 4, 5) of the platform 1 has an original aerodynamic convex shape for decreasing the influence of the explosion striking factors. The aerodynamic shape of the lower surface 3 of the platform 1 is made in such a way that it has the convex protrusion 6 facing downwards along the length of the lower surface 3 of the platform 1 with the vertex 9 and with the two inclined surfaces 7, 8 (FIG. 1, 3, 4, 5). The vertex 9 of this protrusion 6 (together with the two adjacent inclined surfaces 7, 8) are made and arranged along the central axis of the lower surface 3 of the platform 1 in such a way that the lower surface 3 of the platform 1 does not have any flat and parallel horizontal surfaces in a projection of the human foot to the bottom of the platform 1 relative to the upper surface 2 of the platform 1 and relative to the ground surface. The vertex 9 of the protrusion 6 may be made rounded along its entire length. In various separate embodiments of the structure, each of the two lateral inclined surfaces 7, 8 may be flat or curved. In any embodiments of the structure, each of the two lateral inclined surfaces 7, 8 is arranged at the angle $\alpha$ (FIG. 4) relative to the ground surface and to the surface 2.

As mentioned above, the platform 1 comprises the support legs 4 which are connected to the lower surface 3 of the platform 1 and contact by their own support surfaces 11 with the surface (ground, soil, snow, other). In preferable embodiments, the structure of the anti-mine pad comprises four support legs 4, and two of them are arranged in the front part of the platform 1, while other two support legs 4 are arranged in the rear part of the platform 1. Preferably, each of the support legs 4 completely extends in longitudinal and lateral directions (along diagonals) relative to nominal corners of the platform 1 so as to provide stable support of the platform 1 on the ground surface in such a way that the points (places) of contact between the support legs 4 (the own support surfaces 11 of the legs 4) and the ground surface are arranged outside the edges of the platform 1 (FIG. 1-6).

The arrangement location, direction, inclination angle, length and height of the support legs 4 are made so as to provide the arrangement of the upper surface 2 of the platform 1 above the ground surface at the height h2 (FIG. 3) that is from 40 mm to 99 mm.

In separate embodiments of the invention, the support legs 4 may be interconnected in the area of their own support surfaces 11 by means of elements which are made of elastic polymer (not shown in the drawings). For example, the support legs 4 may be interconnected by means of four horizontal "bridges" along the circumference or merely by means of two longitudinal "bridges" which are arranged at sides or by means of two transverse front and rear "bridges". Besides, the support surfaces 11 of the support legs 4 may have different area which is greater or smaller depending, e.g., on the size of the anti-mine pad.

Also, in separate embodiments of the invention, the level of the lower support surface 11 of each of the support legs 4 and the lower level of the vertex 9 of the convex protrusion 6 may lie in the same plane, i.e., in these embodiments, the convex protrusion 6 also serve as a "support" element together with the support legs 4. Alternatively, the height h1 between the level of the lower support surface 11 of each of the support legs 4 and the lower level of the vertex 9 of the convex protrusion 6 may be greater than 0.1 mm, i.e., in these embodiments, the convex protrusion 6 is arranged higher than the "support level" and the convex protrusion 6 does not serve as a "support" element (FIG. 3).

The platform 1 is formed by the rigid polymeric inner frame (not shown in the drawings) and the polymeric outer shell 10 (FIG. 1, 2) that is applied to the inner frame. The rigid polymeric material of the inner frame has a greater rigidity and mechanical strength as compared to the material of the outer shell 10. Thus, the inner frame is a base which the polymeric outer shell 10 is applied on. In various separate embodiments of the structure, the rigid polymeric inner frame may be made monolithic or composite (made of several parts) which is not shown in the drawings. The material of the polymeric outer shell 10 has a greater flexibility than the rigid polymeric material of the inner frame to provide energy absorption.

As compared to the known similar devices, owing to the use of polymeric materials only for the inner frame and for the outer shell, as well as owing to the small height of the platform 1 and of the support legs 4 (both along and in combination), the anti-mine pad has light weight and small dimensions, thereby enabling its convenient and easy transportation and intended use.

The structure of the anti-mine pad completely lacks any metal elements and details, thereby significantly decreasing a probability of activation of "magnetic" mines, decreasing the weight of the pad and avoids formation of its own damaging metal shards upon explosion.

Anti-Mine Pad Operation

The anti-mine pads are used when it is necessary to go through mined areas or to clear the mined areas.

The device is fastened on the footwear by means of the fastening elements (the openings 5 provided on the platform 1 and the straps) in the toe and heel areas, thereby allowing to fasten the anti-mine pad to the footwear, and this fastening is not completely rigid and it does not encompass, fix and "clamp" the foot along its entire circumference, rather it fixes the pad merely in the front and rear parts of the platform 1 which is an important factor at the moment of explosion. In other embodiments, special footwear is used, where the claimed anti-mine pad is an integral part (the sole) of this footwear.

The rigid horizontal platform 1 and the upper surface 2 (formed by the polymeric outer shell 10 and, in some embodiments, with the corrugated upper surface 2) enable to conveniently mount the footwear thereon and, together with the several support legs 4, enable the human to go through the mined areas. The rigid polymeric inner frame of the anti-mine pad (the frame is present both inside the platform 1 and inside each of the support legs 4) provides the required vertical and horizontal rigidity of the pad in order to enable withstanding of the mass/weight load of an armed soldier having special equipment during walking.

If the human leg with the anti-mine pad steps on the anti-personnel mine, the explosion will occur. In most of such cases, the mine will be activated by one or two support legs 4 and their contact points with the ground surface are arranged outside the platform 1 and, thus, the explosion epicenter also will be arranged at a small distance, but still outside the platform 1, which will somehow decrease the influence of the brisant action onto the platform 1, the footwear and the human foot. In the same way, the mine may be activated due to the contact with the lower surface 3 of the platform 1 (at low values of the height h1 or when the vertex 9 of the convex protrusion 6 is arranged at the same level with the support surfaces 11 of the support legs 4), and then the entire energy of the brisant action will act onto the lower surface 3 of the platform 1 from the bottom to the top. The brisant action of the explosion arises only in close proximity to the charge at a distance that is not greater than 2.0-2.5 of the charge radius, i.e., the brisant action of the explosion takes place at small distance from the explosion epicenter. Thus, upon contact with the mine, in most of cases, the brisant action firstly will affect the aerodynamic convex surface of the lower surface 3 of the platform 1 that is the closest one to the explosion. The convex protrusion 6 of the lower surface 3 (that is arranged with its vertex 9 towards the ground surface) will partially "dissect/dissipate/divide" the explosion energy from the vertex 9 of the convex protrusion 6 along the two angular inclined surfaces 7, 8 towards lateral sides from the human foot. Therefore, owing to the fact that the lower surface 3 of the platform 1 completely lacks any flat and parallel horizontal surfaces relative to the ground surface and relative to primarily vertical and perpendicular direction of the brisant action of the explosion from the bottom to the top, the explosion energy will not act "directly" onto the convex lower surface 3 of the platform 1 itself and, thus, will not act "directly" onto the human foot, since its damaging action will be decreased. However, in practice, the explosion brisant action has such a power that the aerodynamic convex surface of the lower surface 3 does not allow to completely dampen this destructive brisant action and to completely redirect it in other directions. Considering that: "Brisance is an ability of explosion substances (ES) to shatter and to break media which are adjacent to the ES charge upon explosion; the brisance is caused by impact action of detonation products and it appears only at close proximity to the charge at a distance that is not greater than 2.0-2.5 of the charge radius (that's why it is called as "local action of the explosion"); the brisant action is only a portion of the explosion and it is caused by the main part of the explosion impulse, i.e., the operation of the detonation products upon decrease of their pressure in a relatively narrow range" , while according to the invention, the arrangement height h2 of the upper surface 2 of the platform 1 above the ground surface is from 40 mm to 99 mm, i.e., the platform 1 is arranged directly in the brisant action area of the possible explosion of the anti-personnel pressure-type mine, and the 40 mm distancing from the ground surface decreases the brisant action only partially. As a result of a residual energy of the explosion brisant action, the platform 1 is separated at least into two parts, while the rigid frame is destroyed as well.

At the same time:

- a part of the energy is partially "withdrawn" in two directions by the convex protrusion 6 and by the two angular inclined surfaces 7, 8 from the human foot that is horizontally and perpendicularly arranged relative to the direction of action of the explosion energy;
- most of the explosion energy is consumed to destroy the polymeric platform 1, i.e., firstly the polymeric outer shell 10 is destroyed, and then the rigid inner polymeric frame is destroyed;
- at the same time, the platform 1 is destroyed (broken) into pieces which do not have any damaging and dangerous properties for the human due to characteristics of the polymeric material of the outer shell 10;
- the rigid and fragile inner frame also absorbs the residual destructive energy and, at the same time, is also destroyed (broken) into parts which also do not have any damaging and dangerous properties for the human due to characteristics of the polymeric material of the inner frame;
- when the anti-mine pad is made as the separate device, the platform 1 will be destroyed (broken into parts) at the moment of the explosion, and since the fastening elements are made as the openings 5 in the "toe area" and in the "heel area" of the platform 1 and as the flexible straps (fixation elements) which are inserted into said openings 5, the human foot will be easily and quickly got free of the remainders of the platform 1 and of the flexible straps (FIG. 10, 11), while there will be no twisting, deformation, destruction, damaging of the foot under the action of the explosion energy, since the foot is not fixed on the platform 1 in a completely rigid fashion;
- when the anti-mine pad is made as the integral part of the footwear, the platform 1 also will be destroyed (broken into parts) at the moment of explosion, and owing to the fact that the fastening elements for fastening the platform 1 to the upper part of the footwear are made as adhesive seams or casting connection points which are provided and arranged so as to enable "easy" separation of the platform 1 from the footwear, the human foot also will be easily and quickly got free of the remainders of the platform 1, while there will be no twisting, deformation, destruction, damaging of the foot under the action of the explosion energy, since the foot is not fixed on the platform 1 in a completely rigid fashion.

During experimental tests and studies of the anti-mine pad (in the majority of cases), the structure of the platform 1 will be destroyed (broken) into several parts under the explosion action, while absorbing the main part of the explosion energy and significantly decreasing the brisant action that will not reach the human foot itself owing to the structure of the pad. It should be also noted that the aerodynamic shape of the lower surface 3 of the platform 1 in the form of the convex protrusion 6 with the two inclined surfaces 7, 8 also allows to protect the human and the foot against the influence of the explosion striking factors due to absence of any surfaces parallel to the surface 2. Small rigid, solid and sharp shards of the platform 1 itself and other details of the structure which may damage the human do not bear any crucial damage, since the pad does not comprise any metal or other similar elements. The shards of the destroyed platform 1 will easily free the foot (by bouncing away therefrom) without causing any serious injures of the human leg. And as mentioned above, in this case, no "twisting" of the platform 1 together with the foot will occur and, thus, no traumatic deformation of the leg will occur. A maximum possible injure of the foot that could be caused when using the anti-mine pad upon stepping on the anti-personnel pressure-type mine (e.g., PFM-1 or PFM-2, but without limitation thereto) will be foot bones breakage or serious bruise, but there will be no serious destructive damages of the foot or crush of the foot which could be life-threatening for the human and would require emergency evacuation and taking special complex medical care.

Since the structure of the pad does not comprise any metal details, elements, pieces, modern magnetic mines will not be activated when using the pad on the mined area.

The structure of the pad is simple and has relatively small dimensions, thereby allowing its convenient transportation without involvement of any additional equipment.

Industrial applicability and achievement of the technical effects when using the anti-mine pad "SafeStep" have been confirmed many times during conduction of experimental tests of the pad in practice together with the footwear and with the foot model. Conduction of these experiments is illustrated in the photos which show a comparative influence of the explosion onto the footwear and onto the foot model with the anti-mine pad and without the anti-mine pad. As it can be seen from these photos:

- the footwear with the foot model that has been exploded without the anti-mine pad has been destroyed completely;
- the footwear with the foot model that has been exploded with the anti-mine pad has remained integral and without any significant damages, and only the anti-mine pad has been destroyed.

The invention claimed is:

1. An anti-mine pad comprising a rigid horizontal platform (1), support legs (4) and footwear-fastening elements, and said platform (1) has an upper surface (2) for a footwear and a lower surface (3) having a convex shape to reduce an influence of explosion striking factors, and the support legs (4) are connected to the lower surface (3) of the platform (1), contact by their own support surfaces (11) with a ground surface and arranged in such a way that contact points between the support legs (4) and the ground surface are located outside the platform (1), and the platform (1) is arranged on the support legs (4) in such a way that it provides a space h2 between the upper surface (2) and the ground surface, wherein the lower surface (3) of the platform (1) is made such that it has a convex protrusion (6) with a vertex (9) and two inclined surfaces (7), (8), and the vertex (9) of this convex protrusion (6) faces towards a bottom of the anti-mine pad and arranged primarily along a central axis of the lower surface (3) of the platform (1) in such a way that the lower surface (3) of the platform (1) in a form of the inclined surfaces (7), (8) and their shared vertex (9) has no parallel planes in a projection of a human foot relative to the upper surface (2), and the structure of the platform (1) with the support legs (4) is formed by a rigid polymeric inner frame and a polymeric outer shell (10) that is externally applied to the rigid polymeric inner frame, and the inner frame rigid polymeric material has a higher rigidity than a polymeric material of the outer shell (10), and the arrangement height h2 of the upper surface (2) of the platform (1) above the ground surface is from 40 mm to 99 mm.

2. The anti-mine pad according to claim 1, wherein each of the two lateral inclined surfaces (7), (8) of the convex protrusion (6) of the lower surface (3) of the platform (1) is curved or flat and arranged at an angle $\alpha$ relative to the upper surface (2).

3. The anti-mine pad according to claim 1, wherein it comprises four support legs (4), and two of them are arranged in a front part of the platform (1), while other two support legs (4) are arranged in a rear part of the platform (1).

4. The anti-mine pad according to claim 1, wherein the support legs (4) are interconnected in an area of their own support surfaces (11) by means of elements which are made of an elastic polymer.

5. The anti-mine pad according to claim 1, wherein a level of the lower support surface (11) of each of the support legs (4) and a lower level of the vertex (9) of the convex protrusion (6) lie in the same plane or a height h1 between the level of the lower support surface (11) of each of the support legs (4) and the lower level of the vertex (9) of the convex protrusion (6) is 0.1 mm or more than 0.1 mm.

6. The anti-mine pad according to claim 1, wherein the upper surface (2) of the platform (1) has a corrugated surface.

7. The anti-mine pad according to claim 1, wherein it is made as an individual device, and the footwear-fastening elements are openings (5) which are provided in both a "toe area" and a "heel area" of the platform (1) and straps which are inserted into said openings (5) of the platform (1) so as the straps are attachable to the footwear and enable a detachment of the fastening elements under a brisant action of an explosion and due to a destruction of the platform (1).

8. The anti-mine pad according to claim 1, wherein it is made as an integral part of the footwear.

* * * * *